US005296100A

United States Patent [19]

Devic

[11] Patent Number: 5,296,100

[45] Date of Patent: * Mar. 22, 1994

[54] $H_2O_2$/ALKALINE BLEACHING OF WOOD PULPS

[75] Inventor: Michel Devic, Sainte Foy Les Lyon, France

[73] Assignee: Atochem, Puteaux, France

[ * ] Notice: The portion of the term of this patent subsequent to Dec. 8, 2009 has been disclaimed.

[21] Appl. No.: 693,800

[22] Filed: Apr. 30, 1991

[30] Foreign Application Priority Data

Apr. 30, 1990 [FR] France ..... 90 05749

[51] Int. Cl.[5] ..... D21C 9/16

[52] U.S. Cl. ..... 162/78; 162/90

[58] Field of Search ..... 162/76, 78, 19, 90, 162/80

[56] References Cited

U.S. PATENT DOCUMENTS

| | | | |
|---|---|---|---|
| 4,732,650 | 3/1988 | Michalowski et al. | 162/78 |
| 4,734,161 | 3/1988 | Dubreux | 162/78 |

FOREIGN PATENT DOCUMENTS

| | | | |
|---|---|---|---|
| 0208625 | 1/1987 | European Pat. Off. . | |
| 2601380 | 7/1976 | Fed. Rep. of Germany | 162/78 |
| 3333219 | 3/1984 | Fed. Rep. of Germany | 162/78 |
| 57-25492 | 2/1982 | Japan | 162/78 |
| 88/02796 | 4/1988 | World Int. Prop. O. . | |

OTHER PUBLICATIONS

*Tappi Journal*, vol. 70, No. 3, (Mar. 1987) by Lachenal.

Colodette et al., "The Effect of pH Control on Peroxide Brightening of Stoneground Wood Pulp", *J. of Pulp and Paper*, Mar. 1990, (162–78).

Anderson et al., "Optimized Hydrogen Peroxide Bleaching in Closed White Water Systems"; *TAPPI*, Apr. 1980, pp. 111–115 (162–78).

*Primary Examiner*—Steve Alvo

*Attorney, Agent, or Firm*—Burns, Doane, Swecker & Mathis

[57] ABSTRACT

High-yield lignocellulosic wood pulps are bleached by (i) first pretreating such pulp with a complexing agent for metal ions and next washing the pretreated pulp, and then (ii) bleaching such pretreated/washed pulp with an initial amount of hydrogen peroxide in an alkaline medium, including adding a supplementary bleaching amount of hydrogen peroxide and a supplementary amount of an alkaline agent to the pulp over the course of the bleaching step (ii) without interrupting same, at a point in time when from 60% to 85% of the initial amount of hydrogen peroxide has been consumed, and such supplementary amount of hydrogen peroxide being equal to or less than the initial amount thereof.

9 Claims, No Drawings

$H_2O_2$/ALKALINE BLEACHING OF WOOD PULPS

CROSS-REFERENCE TO COMPANION APPLICATION

Copending application Ser. No. 07/693,629, now U.S. Pat. No. 5,169,495, filed concurrently herewith and assigned to the assignee hereof.

BACKGROUND OF THE INVENTION

1. Field of the Invention

The present invention relates to the bleaching of high-yield wood pulp with hydrogen peroxide in an alkaline medium.

By the term "high-yield wood pulp" are intended the wood and paper pulps produced in a high yield by weight in the dry state relative to the starting lignocellulosic material, typically in the form of chips, constituting the dry state, namely, a yield greater than about 85% and often at least 90% by weight.

2. Description of the Prior Art

The aforedescribed wood pulps are characteristically produced by grinding the above starting material, typically wood chips, by means of a mill or a disc grinder, whether or not accompanied by a chemical and/or heat treatment.

Exemplary are those referred to in this art as mechanical, thermomechanical and chemithermomechanical pulps.

Two types of processes are currently employed to carry out the bleaching of such pulps:

(a) a first technique which entails reacting the pulp with a reducing agent, traditionally hydrosulfite, under mild conditions and in a neutral or slightly acidic medium. This results in a partial bleaching which is nonetheless sufficient for certain applications;

(b) a second technique which entails reacting the pulp with hydrogen peroxide in an alkaline medium; the bleaching attained thereby is greater than in the first process, which explains why the peroxide process is presently increasingly employed to satisfy various paper quality requirements.

However, hydrogen peroxide is costly and its stability decreases as the pH increases. While it is accepted in this art that the pH range in which the bleaching with hydrogen peroxide is normally carried out extends from approximately 9 to approximately 11, as reported in "The Bleaching of Pulp", TAPPI Press, Singh ed., p. 227, Atlanta (1970), continuing need exists in the industry for further improvements in the area of such hydrogen peroxide processing.

It has thus been proposed to this art to use the hydrogen peroxide in at least two separate bleaching stages.

For example, in published application WO-84/02,366 a first stage is described in which the alkalinity conditions are abnormally high with a view to improving the mechanical quality of the fibers, and a second stage under conditions of normal alkalinity to compensate for the bleaching deficiency resulting from the first stage.

In TAPPI Journal, March 1987, pages 119 et seq., D. Lachenal also describes a two-stage process, but in which an amount of sodium hydroxide is used in the second stage which is much greater than that normally employed for a first stage.

Finally, French Patent No. 2,537,177 recommends maintaining conditions which are as uniform as possible throughout the bleaching operation while utilizing a succession of separate stages.

In each of the above processes, one stage differs from the following one in that the materials which have been used in the first, in particular hydrogen peroxide and alkaline agents such as sodium hydroxide, are intermediately removed from the pulp, at least for the most part, for example 90%, normally by washing and/or pressing the pulp. The resulting energy and capital costs militate against improving the efficiency of usage of the hydrogen peroxide.

SUMMARY OF THE INVENTION

Accordingly, a major object of the present invention is the provision of an improved two-stage process for the $H_2O_2$ bleaching of wood pulp in an alkaline medium, which improved process does not require any intermediate or in-line removal of the $H_2O_2$ or alkaline agents during the overall bleaching operation.

Briefly, the present invention features the bleaching of high-yield pulps in which the pulp to be bleached is first subjected to a pretreatment with a complexing agent for metal ions, followed by a washing thereof, and then it is treated with hydrogen peroxide in an alkaline medium, said $H_2O_2$ treatment comprising the addition of supplementary amounts of hydrogen peroxide and of alkaline agent to the pulp over the course of such treatment and without interrupting same, at that point in the bleaching operation when 60% to 85% of the initial amount of the hydrogen peroxide has been consumed and such supplementary amount of hydrogen peroxide being equal to or less than the initial amount thereof.

DETAILED DESCRIPTION OF THE PREFERRED EMBODIMENTS OF THE INVENTION

More particularly according to the present invention, by the term "pulp" is intended the combination of the lignocellulosic material in the dry state together with the liquid content thereof.

And in the following description and actual working examples, all parts and percentages are given by weight relative to the weight of the pulp in the dry state, unless otherwise indicated.

The pretreatment with the complexing agent for metal ions is typically carried out at a temperature which is normally less than 100° C. but higher than 20° C., for example ranging from 50° C. to 95° C., at a consistency (referring to the percentage of pulp in the dry state) ranging from 5% to 30% and typically from 10% to 15%, for a period of time which depends on the other process parameters but which advantageously ranges from 5 minutes to 2 hours, at a pH ranging from 4 to 8. The complexing agent is used in a proportion which advantageously ranges from 0.1% to 1%, and typically from 0.2% to 0.5%. Particularly exemplary such complexing agents include sodium tripolyphosphate, sodium tetrapyrophosphate, and the sodium salts of citric, nitrilotriacetic, ethylenediaminetetraacetic and diethylenetriaminepentaacetic (DTPA) acids.

The washing step following the pretreatment with the complexing agent entails removing, more or less completely and as efficiently as possible, the liquid which is present in the pulp, for example by pressing the pulp on a filter or by first diluting the pulp, advantageously with water, and then pressing or squeezing same. Such operation(s) is (are) carried out one or more times. Efficiency, expressed as a percentage, is the degree of removal of the liquid present in the pulp prior to washing. In the process of the invention, the desired efficiency of washing is at least 75%.

The amount of hydrogen peroxide $H_2O_2$ introduced at the beginning of the treatment of the pulp which has been pretreated and washed as indicated above advantageously ranges from 0.5% to 6%, preferably from 3% to 5%.

The supplementary amount of $H_2O_2$ added during the treatment with $H_2O_2$ in an alkaline medium according to this invention advantageously ranges from 0.25% to 3% and is, in all cases, also as indicated above, equal to or less than the amount of $H_2O_2$ introduced at the beginning of the treatment.

The most preferred alkaline agent to be used in conjunction with the $H_2O_2$ is sodium hydroxide, NAOH.

The amount of NAOH added to the pulp with the $H_2O_2$ at the beginning of treatment, and also the supplementary amount of NAOH added during the treatment with the additional $H_2O_2$, depends essentially on the amount of $H_2O_2$ and also on the nature of the wood pulp and on the other parameters of the treatment process. The first of these two amounts of NaOH advantageously ranges from 0.5% to 6%, and typically ranges from 1.5% to 4%; the second amount may also range from 0.5% to 6%, and preferably from 1% to 3%.

As in the processes known to the prior art, the treatment of the pulp with the $H_2O_2$ in an alkaline medium may be carried out in the presence of a stabilizer for $H_2O_2$, such as, for example, sodium silicate, as well as in the presence of a complexing agent for metal ions, such as, for example, DTPA in the form of the sodium salt thereof. For example, from 1% to 4% of an aqueous solution of sodium silicate having a relative density of 1.33 and from 0% to 0.5% of an aqueous solution containing 40% by weight of the sodium salt of DTPA may be added with the $H_2O_2$ and NAOH at the beginning of the treatment, and from 0% to 4% of said silicate solution and from 0% to 0.5% of said solution of DTPA salt may be added during the bleaching sequence with the additional amounts of $H_2O_2$ and NAOH which are added to the pulp.

The treatment with the $H_2O_2$ in an alkaline medium is normally carried out at a temperature ranging from 60° C. to 90° C., typically at a temperature ranging from 65° C. to 75° C., at a consistency which is as high as possible, for example ranging from 15% to 45%. The period of treatment with the $H_2O_2$ added with the NAOH upon initiation of the process sequence, as well as that of the $H_2O_2$ added with the NAOH during the treatment according to the invention, depends principally on the temperature and on the amount of $H_2O_2$; each of these time periods advantageously ranges from 1 hour to 6 hours.

It has also been found that it is frequently advantageous to carry out the addition of the supplementary amounts of $H_2O_2$ and of the NAOH during the treatment when approximately 70% to 80% of the amount of $H_2O_2$ introduced initially has been consumed.

In order to further illustrate the present invention and the advantages thereof, the following specific examples are given, it being understood that same are intended only as illustrative and in nowise limitative.

EXAMPLES 1 to 8

In each of these examples, the pulp subjected to the bleaching process was a mechanical grindstone pulp constituted of, by weight, 75% of softwood and 25% of hardwood, and its brightness was 63.2°ISO. Also, prior to the treatment with $H_2O_2$ in an alkaline medium, the pulp was subjected to a pretreatment, at a consistency of 10%, with a 0.5% aqueous solution containing 40% by weight of the sodium salt of DTPA at 90° C. for 15 minutes, followed by washing at an efficiency of 90%.

The treatment with the $H_2O_2$ in an alkaline medium was carried out, in each instance, in the absence of any complexing agent for metal ions, at a temperature of 70° C., at a consistency successively equal to 20% before the supplementary additions of $H_2O_2$ and of NAOH were made, and to 15% after such additions.

The amounts of $H_2O_2$, sodium silicate solution having a relative density of 1.33 (referred to simply as silicate), in % by weight relative to the pulp in the dry state, are reported in the single Table below, which Table also reports the brightness values of the pulp which had been subjected either to the process of the invention or to a known process only comprising a washing step referred to as W, at an efficiency of 90%, prior to supplementary addition of at least $H_2O_2$ and NAOH.

The length of time of the bleaching treatment was 7 hours in each instance.

TABLE

| Example No. | Amounts introduced at the beginning of treatment (%) | | | $H_2O_2$ consumed before supplementary addition of $H_2O_2$ and of NaOH, % of $H_2O_2$ introduced at the beginning of treatment | WASHING | Supplementary addition (%) | | | Bleached pulp brightness °ISO |
|---|---|---|---|---|---|---|---|---|---|
| | $H_2O_2$ | NaOH | Silicate | | | $H_2O_2$ | NaOH | Silicate | |
| 1 | 3 | 2 | 3 | 72 | no | 1 | 1 | 2 | 82.8 |
| 2* | 3 | 2 | 3 | 72 | yes | 1 | 1 | 2 | 81.1 |
| 3 | 4 | 3.5 | 3 | 80 | no | 2 | 1.5 | 3 | 84.4 |
| 4* | 4 | 3.5 | 3 | 80 | yes | 2 | 1.5 | 3 | 83.7 |
| 5 | 4 | 3.5 | 3 | 80 | no | 2 | 0.5 | 0 | 83 |
| 6* | 4 | 3.5 | 3 | 80 | yes | 2 | 0.5 | 0 | 82.4 |
| 7** | 2 | 1.5 | 3 | 87 | no | 2 | 1.5 | 3 | 82.2 |
| 8* | 2 | 1.5 | 3 | 87 | yes | 2 | 1.5 | 3 | 82.1 |

*tests given by way of comparison
**tests at the limits of the invention.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for the bleaching of a high-yield lignocellulosic pulp, comprising (i) first pretreating said pulp with a complexing agent for metal ions and next washing such pretreated pulp, and then (ii) bleaching said pretreated/washed pulp with an initial amount of hydrogen peroxide ranging from 3% to 5% in an alkaline medium, including the addition of a supplementary bleaching amount of hydrogen peroxide and a supplementary amount of sodium hydroxide ranging from 0.5 to 1.5% to said pulp, all the above percentages being by weight based on the weight of the pulp in the dry state, said addition being carried out over the course of said bleaching step (ii) without interrupting same and wherein the hydrogen peroxide or the alkaline treatment agent are not removed during the beaching, at a point in time when from 70% to 80% of the initial amount of hydrogen peroxide has been consumed.

2. The process as defined by claim 1, said supplementary amount of hydrogen peroxide ranging from 0.25% to 3% by weight of the pulp in the dry state thereof.

3. The process as defined by claim 1, wherein both the initial amount of sodium hydroxide and the supplementary amount thereof ranges from 0.5% to 1.5% by weight of the pulp in the dry state thereof.

4. The process as defined by claim 1, comprising conducting said bleaching step (ii) in the presence of a minor amount of sodium silicate.

5. The process as defined by claim 1, comprising conducting said bleaching step (ii) in the presence of a metal ion complexing agent.

6. The process as defined by claim 1, comprising conducting said bleaching step (ii) at a consistency ranging from 15% to 45%.

7. The process as defined by claim 1, comprising conducting said pretreatment step (ii) at a pH ranging from 4 to 8.

8. The process as defined by claim 1, comprising conducting said pretreatment step (i) with from 0.1% to 1% by weight of said complexing agent for metal ions.

9. The process as defined by claim 8, said complexing agent for metal ions comprising sodium tripolyphosphate, sodium tetrapyrophosphate, or a sodium salt of citric, nitrilotriacetic, ethylenediaminetetraacetic or diethylenetriaminepentaacetic acid.

* * * * *